US011815077B2

(12) United States Patent
Hutchings et al.

(10) Patent No.: US 11,815,077 B2
(45) **Date of Patent: *Nov. 14, 2023**

(54) METHOD FOR PUMPING FOAMED FLUIDS INTO A WELL BORE OR SUBTERRANEAN FORMATION

(71) Applicant: RheoVest, LLC, Shreveport, LA (US)

(72) Inventors: Nathan R. Hutchings, Shreveport, LA (US); Timothy Blaine Whisenhunt, Bossier City, LA (US)

(73) Assignee: RHEOVEST, LLC, Shreveport, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/053,544

(22) Filed: Nov. 8, 2022

(65) Prior Publication Data

US 2023/0060929 A1 Mar. 2, 2023

Related U.S. Application Data

(63) Continuation of application No. 17/465,757, filed on Sep. 2, 2021, now Pat. No. 11,578,712.

(51) Int. Cl.

| | |
|---|---|
| ***F04B 23/04*** | (2006.01) |
| ***F04B 15/02*** | (2006.01) |
| ***F04C 11/00*** | (2006.01) |
| ***E21B 41/00*** | (2006.01) |

(52) U.S. Cl.

CPC ..... *F04B 23/04* (2013.01); *E21B 41/00* (2013.01); *F04B 15/02* (2013.01); *F04C 11/00* (2013.01)

(58) Field of Classification Search

CPC ..... F04B 23/04; F04B 15/02; E21B 41/00; E21B 43/166; E21B 21/14; F04C 11/00

See application file for complete search history.

(56) References Cited

U.S. PATENT DOCUMENTS

| | | | | |
|---|---|---|---|---|
| 4,488,598 | A | 12/1984 | Duerksen | |
| 11,578,712 | B1 * | 2/2023 | Hutchings | F04B 15/02 |
| 2004/0256099 | A1 | 12/2004 | Nguyen et al. | |
| 2011/0272133 | A1 | 11/2011 | Piper | |

FOREIGN PATENT DOCUMENTS

| | | |
|---|---|---|
| GB | 2450565 A | 12/2008 |
| GB | 2526820 A | 12/2015 |

(Continued)

OTHER PUBLICATIONS

International Search Report and Written Opinion dated Apr. 27, 2022, for International application PCT/US22/13910.

(Continued)

*Primary Examiner* — James G Sayre
(74) *Attorney, Agent, or Firm* — Richard A. Fagin

(57) ABSTRACT

A method for pumping a liquid-gas mixture into a subsurface well includes introducing gas into a liquid at a first pressure to generate a mixture. The mixture is pumped through a first positive displacement pump to a second pressure greater than the first pressure. The mixture at the second pressure is pumped through at least a second positive displacement pump to a third pressure greater than the second pressure. The mixture is moved into the subsurface well at at least the third pressure.

24 Claims, 2 Drawing Sheets

(56) References Cited

FOREIGN PATENT DOCUMENTS

| | | | | |
|---|---|---|---|---|
| GB | 2544757 A | | 5/2017 | |
| GB | 2544757 B | * | 5/2021 | ..... E21B 43/164 |

OTHER PUBLICATIONS

Tsai. M.J .. "Accounting for dissolved gases in pump design" . Chemical Engineering .. Jul. 26, 1962.
Communications Power Zone. "Charge Pump"; https://medium.com/@communications_21063/charge-pump-f526bf984f16 .. Apr. 17, 2018.
Pumpscout. "Pump Types Guide—Find the right pump for the job"; http://www.pumpscout.comtarticles-scout-guide/pump-types-guide-aid 1 OD.html .. Feb. 27, 2020.
Toolbox. "Pumps in Parallel or Serial" . https://www.engineeringtoolbox.com/pumps-parallel-serial-d_636.html. . Dec. 17, 2019.
Naik, et al. "The Effect of Venturi Design on Jet Pump Performance" 23-28. Journal for Research vol. 2(4);http:www.journal4research.org/articles/J4RV214010.pdf.; Jun. 2016.
Office Action dated Jun. 1, 2022. U.S. Appl. No. 17/465,757.

* cited by examiner

METHOD FOR PUMPING FOAMED FLUIDS INTO A WELL BORE OR SUBTERRANEAN FORMATION

CROSS REFERENCE TO RELATED APPLICATIONS

Continuation of U.S. application Ser. No. 17/465,757 filed on Sep. 2, 2021, now U.S. Pat. No. 11,578,712.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of fluids used in the construction and servicing of subsurface wellbores. More specifically, the disclosure relates to methods for producing and pumping foam type fluids, i.e., mixtures of gas and liquid, into underground wells and formations.

Liquid-gas mixtures are commonly used fluid systems for drilling, completions, under-ground boring, or oil and gas well production work-over (intervention) operations having advantages in (1) reducing hydrostatic pressure of the fluid system on the subterranean formation and/or (2) the rheological properties of the fluid system. Liquid-gas mixtures are often referred to as foams, micro-foams, or colloidal gas aphrons depending on the specific size and structure of the gas bubbles present within the base liquid. These gas-liquid mixtures have been applied to all facets of subterranean penetration including oil and gas well drilling, oil and gas well completions, oil and gas well production and remediation, water well drilling, geothermal well drilling, and underground boring (e.g., horizontal directional drilling).

The liquid phase of a liquid-gas mixture can be comprised of fresh water, brines, produced salt water (produced from one or more subsurface formations), sea water, repurposed wastewater, or recirculated field water. Although any gas could theoretically be incorporated into the liquid-gas mixture, the most common gasses introduced to the liquid-gas mixture are nitrogen, atmospheric pressure air, carbon dioxide, or compressed air. Chemical additives are generally introduced into the liquid phase of the mixture to stabilize the final liquid-gas mixture, convey the desired rheological properties to the final mixture, and to provide friction reduction and lubrication to the tubing, drill string, and tooling. Occasionally, other chemical additives are introduced into the mixture to provide protection against bacteria, mineral scaling, and corrosion; and additives may also be introduced that facilitate breakdown of polymers, mineral scale, hydrocarbons, or other debris that may be encountered in the procedure.

A significant challenge with respect to pumping liquid-gas mixtures is that conventional pumping methods require either (a) introducing the gas fraction of the mixture on the "high pressure" side of the pump that is conveying the fluid into the drill string, tubing or bore hole, or (b) limiting the amount of gas introduced to the fluid system to less than 20% by weight of the liquid fraction to prevent the final pump (the pump that ultimately discharges the liquid-gas mixture, from cavitating or gas-locking. Conventional pumping operations utilize one or more centrifugal pump(s) to convey fluids from tanks, ponds, or reservoirs to the high-pressure pump that conveys the fluid into the wellbore. However, centrifugal pumps are unable to efficiently pump liquid-gas mixtures that have a density less than 80% of the density of the base liquid phase due to fluid slippage at the impeller and/or separation of the gas from the mixture causing loss of prime. Additionally, introducing high pressure gas into a liquid-gas mixture on the low-pressure side of the final pump results in difficulty controlling the liquid-gas mixture ratio and/or damage to the pump due to cavitation or loss of prime. Therefore, pumping methods that enable the conveyance on the low-pressure side of the final pump of liquid-gas mixtures that result in fluid densities between 20% and 80% lower than the initial liquid density would significantly expand the utility and efficiency of liquid-gas mixtures as fluid systems for drilling, completions, under-ground boring, or oil and gas production work-over operations.

SUMMARY

One aspect of the present disclosure is a method for pumping a liquid gas mixture into a well. A method according to this aspect includes introducing gas into a liquid at a first pressure to generate a mixture. The mixture is pumped through a first positive displacement pump to a second pressure greater than the first pressure. The mixture at the second pressure is pumped through a second positive displacement pump to a third pressure greater than the second pressure. The mixture is moved into the subsurface well at at least the third pressure.

In some embodiments, the second pressure is inversely related to a fractional amount of gas in the mixture.

In some embodiments, the first positive displacement pump comprises an axial screw pump capable of discharge pressures between 30 psi and 500 pounds per square inch (psi).

In some embodiments, the first positive displacement pump comprises a lobe pump capable of discharge pressures between 30 pounds per square inch (psi) and 500 psi.

In some embodiments, the first positive displacement pump comprises a piston pump capable of discharge pressures between 30 pounds per square inch (psi) and 500 psi.

In some embodiments, the second positive displacement pump comprises a piston pump capable of discharge pressures between 200 pounds per square inch (psi) and 10,000 psi.

In some embodiments, the introducing gas is performed by induction through a Venturi tube disposed in a line connected to an inlet of the first positive displacement pump.

In some embodiments, the introducing gas is performed using gas at atmospheric pressure.

In some embodiments, the introducing gas is performed by injection at a pressure of 0 to 10 pounds per square inch above the first pressure.

In some embodiments, in the introducing gas is performed using gas compressed above atmospheric pressure.

Some embodiments further comprise moving the mixture from the first positive displacement pump to at least one intermediate positive displacement pump, and moving the mixture from the at least one intermediate positive displacement pump at a first intermediate pressure greater than the second pressure and less than the third pressure.

In some embodiments, the first intermediate pressure is sufficient to avoid cavitation at an inlet to either (i) at least a second intermediate positive displacement pump or (ii) the second positive displacement pump.

In some embodiments, the first intermediate pressure is inversely proportionately greater, by the fractional gas content of the mixture, than a manufacturer specified minimum suction pressure of either the at least a second intermediate positive displacement pump or the second positive displacement pump.

Some embodiments further comprise moving the mixture at the first intermediate pressure to the at least a second intermediate positive displacement pump, and pumping the mixture from the at least a second intermediate positive displacement pump at a second intermediate pressure greater than the first intermediate pressure and less than the third pressure.

In some embodiments, the second pressure is sufficient to avoid cavitation at an inlet to the second positive displacement pump.

Other aspects and possible advantages will be apparent from the description and claims that follow.

DETAILED DESCRIPTION

Figure 1:
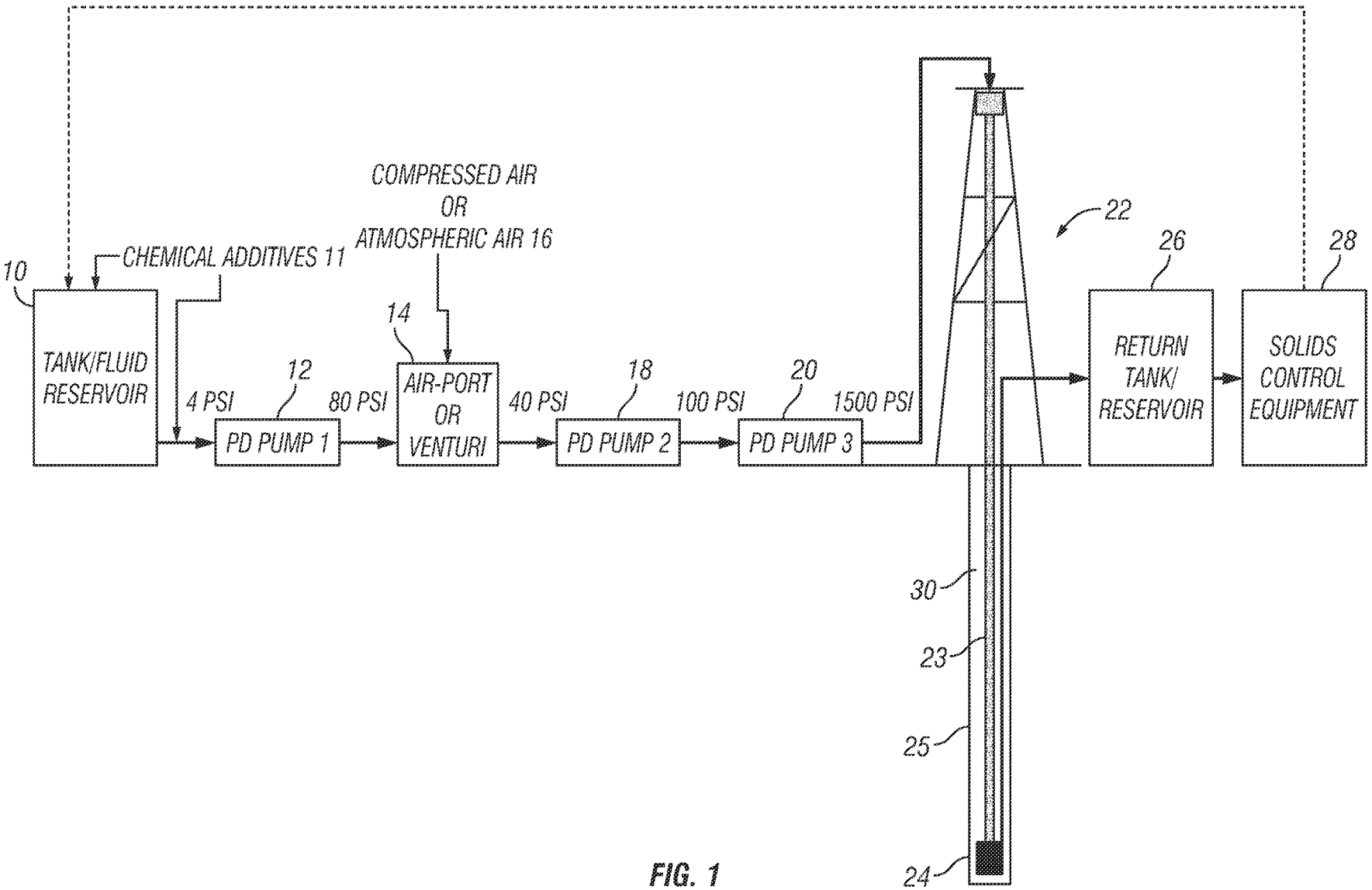
FIG. 1 shows an example pumping system that may be used in accordance with the present disclosure.

Methods for making and pumping gas-liquid mixtures disclosed herein may use a plurality of positive displacement pumps connected in series (the "series") in a fluid pumping system, and one or more in-line ports into which gas can be introduced to the liquid fraction of the fluid system while flowing through a pipe into the intake of one of the pumps in the series. An example embodiment of a pumping system that may be used in accordance with the present disclosure is shown in FIG. 1. The gas-liquid mixture ("mixture" for convenience hereafter) may be used, for example to perform various operations on or in a subsurface wellbore 22. The mixture may be pumped into the wellbore 22, may be discharged from a drill bit, mill or other intervention device, shown generally at 24, and then returned to surface for temporary storage in a tank or pit 26 and subsequent processing to remove solids and other contaminants at 28. Cleaned liquid may then be returned to a liquid storage tank 10 for reuse.

In making and pumping the mixture, liquid from the tank 10 may be moved to the inlet of a transfer pump 12. The transfer pump 12 may be any type, including both centrifugal and positive displacement pumps because it is contemplated that the transfer pump 12 will move substantially only liquid and/or liquid/solid mixtures. Additives intended to cause the liquid to have specific properties may be introduced to the liquid at 11, prior to moving the liquid into the transfer pump 12. Such introduction may be by gravity or by pumping using any form of chemical pump. "Additives" as that term is used herein may be in solid (e.g., as particles or powder) form or liquid form, so as to distinguish them from gas to be mixed with the liquid fraction to generate the mixture.

Gas 16, in the form of air or other suitable gas, at atmospheric pressure or compressed to a pressure above atmospheric, may be introduced to the liquid through an injection port or induction port (e.g., Venturi tube) at 14 disposed between the discharge of the transfer pump 12 and an inlet to a first positive displacement pump 18. It will be appreciated that a Venturi device may be used where the gas 16 is at atmospheric pressure or any other pressure below the pressure at the inlet of the first positive displacement pump 18. At this point, all or part of the mixture is generated. The mixture may be conducted to the inlet of the first positive displacement pump 18. Discharge of the mixture from the first positive displacement pump 18 may be conducted to the inlet of a second positive displacement pump 20. The discharge from the second positive displacement pump 20 may be directed into the wellbore 22 as previously explained. In the case that only part of the desired gas amount in the mixture is introduced between the transfer pump 12 and first positive displacement pump 18, the mixture may be conveyed to the inlet of at least one series connected, intermediate positive displacement pump (not shown) with additional gas being introduced into the mixture by an injection or induction port located between the discharge of the first positive displacement pump 18 and the intermediate positive displacement pump. In such cases, the final mixture is ultimately conveyed into the second positive displacement pump 20 (which may be the final positive displacement pump in the series) at an intake sufficient pressure to prevent cavitation or loss of prime. Further intermediate positive displacement pumps may be similarly connected in series between the outlet of the first positive displacement pump 18 and the inlet of the second positive displacement pump 20 to obtain larger gas fractions in the mixture and/or higher discharge pressure to the inlet of the second positive displacement pump.

Positive displacement pumps have been shown to be efficient for moving liquid-gas mixtures because the nature of a positive displacement pump prevents fluid slippage, prevents liquid-gas separation, provides consistent positive discharge pressure, and isolates the intake and discharge line pressures from one another across the pump. There are multiple types of positive displacement pump that may be used in methods according to the present disclosure, including but not limited to piston pumps, plunger pumps, diaphragm pumps, gear pumps, lobe pumps, progressive cavity screw pumps, rotary vane pumps, and cam pumps. It has been determined through testing on gas-liquid mixtures that lobe pumps and progressive cavity screw pumps appear to be most efficient and scalable for use in pumping such mixtures.

Figure 2:
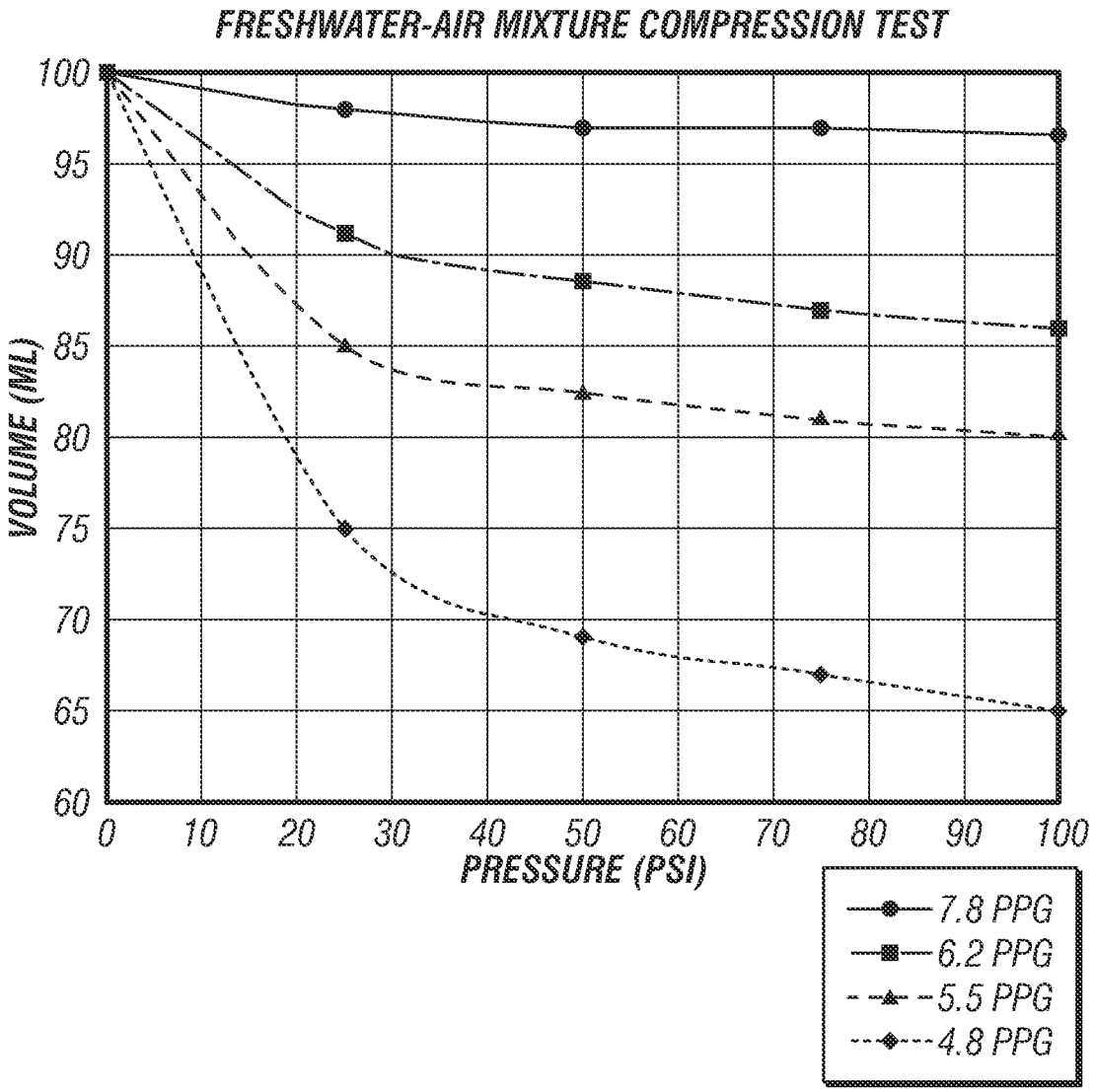
FIG. 2 shows a graph of compressibility with respect to pressure of various liquid-air mixtures.

Introducing low-pressure gas into the liquid while the liquid is flowing through a pipe between two pumps (e.g., the transfer pump 12 and the first positive displacement pump 18) prevents the gas from escaping to atmosphere while being homogenized with the liquid within the pipe, within an in-line mixer, and/or shear mixing by the subsequent pump. Additionally, each positive displacement pump in the series increases the line pressure incrementally and further compresses the gas bubbles within the mixture, thereby causing the fluid system to pump more in the manner of a single-phase (liquid only) fluid. With increasing pressure, the degree of gas compression (size of the gas bubbles) within a mixture follows an exponential decline curve. The size of the gas bubbles gets significantly smaller rapidly when the mixture is initially compressed from ambient pressure, but the smaller the gas bubbles become, the more they resist further compression. The foregoing is illustrated graphically for various density mixtures and pressures in FIG. 2. Tests on various gas-liquid mixtures indicated, for example, that a 4.8 lb/gallon liquid-gas mixture that is 57% by weight fresh water with chemical additives and 43% by weight atmospheric air will compress (reduce in volume)

31% from its uncompressed volume at 50 psi but will compress only 35% by volume from its uncompressed volume at 100 psi. In contrast, a mixture with less gas (6.5% by weight) such as the 7.8 lb/gallon mixture shown in the graph in FIG. 2 only compresses 3.5% by volume between 1 psi and 100 psi. Thus, by in-pipe mixing the liquid and gas and "pre-compressing" liquid-gas mixtures that are greater than 20% by weight gas to a sufficient line pressure as they are conveyed to the final pump in the series (e.g., the second positive displacement pump 20 in FIG. 1) results in the final pump in the series being able to convey the final liquid-gas mixture into a wellbore at high pressure substantially without pump slippage or cavitation at the intake of the final pump or any other pump in the series. The necessary degree of pre-compression of the mixture, and therefore the necessary discharge line pressure of the first positive displacement pump 18, or otherwise second to the last positive displacement pump in the series where intermediate pumps are used, is inversely related to final fluid density (required pre-compression increases as the fluid density decreases). To calculate the minimum intake pressure (suction head) required at the inlet of the last positive displacement pump in the series (e.g., the second positive displacement pump 20), the pump manufacturer's minimum recommended intake pressure should be divided by the fraction by weight of the mixture that is liquid, and the resultant value is the minimum intake pressure necessary to prevent cavitation or loss of prime. Line pressures greater than the minimum as calculated by the method described herein are not detrimental so long as the line pressure is less than the manufacturer's maximum recommended intake pressure, which is typically the point at which the pump may be mechanically damaged. In one example, if the manufacturer's recommended minimum intake pressure to the first positive displacement pump 18 is 40 psi and the mixture is comprised of 57% liquid and 43% gas, then the minimum intake pressure necessary to pump the mixture is 70 psi (40 psi/0.57). Using the test mixtures in FIG. 2 for reference, the 4.8 lb/gal mixture would be compressed to 67% of its ambient pressure volume at 70 psi thereby enabling it to be pumped by the second positive displacement pump 20 as the final pump in the series.

If the pressure drop between the first positive displacement pump 18 and the second positive displacement pump 20 resulting from pressure losses in the surface equipment there between such pipe length, manifolds, valves, tees, elbows, additional incremental gas introduction ports, or combinations thereof is such that the intake pressure of the second positive displacement 20 pump is below the manufacturer's recommended minimum intake pressure divided by the fractional gas content of the mixture, one or more sequential, intermediate positive displacement pumps can be inserted there between to boost the intake pressure to the sufficient pressure to prevent cavitation of the final pump in the series, e.g., the second positive displacement pump 20.

An efficient method of introducing in gas into the mixture into the fluid system is by a Venturi tube or plurality of Venturi tubes between two or more of the pumps in the series; although, tests have also been successfully conducted by using positive pressure (compressed gas) and exceeding the flowing line pressure (between two of the positive displacement pumps) by 0-50 psi, preferably 0-10 psi, to introduce the gas at low working pressures either directly into the flow pipe or though the induction port of a Venturi tube (Venturi-assisted compressed gas injection). Thus, the gas phase of the mixture can be successfully introduced either by induction (e.g. Venturi tube), by injection (compressed gas), or by combination of induction and compression.

In uses of methods according to the present disclosure, other chemical additives may be mixed into the liquid fraction of the mixture to convey desired rheological and lubricating properties to the final mixture. These chemical additives may be premixed with the liquid prior to gas introduction, e.g., at 11 in FIG. 1, although successful injecting has been tested wherein the chemical additives are introduced into the flow line upstream of the first gas introduction port (i.e., at 14 in FIG. 1) as well. The chemical additives in the liquid fraction will typically consist of some combination of the following: Friction reducers such as polyacrylamide, partially-hydrolyzed polyacrylamide, polyethylene oxide, AMPS, acrylamide-acrylic acid co-polymers, and others known to those skilled in the art; Gelling agents (viscosifiers) such as xanthan gum, guar gum, wellan gum, alginates, and others known to those skilled in the art; Surfactants; Lubricants; Biocides; Gel Breakers; Oxygen Scavengers; $H_2S$ Scavengers; Dispersants; and Defoamers; specific chemical compositions and combinations of which are well known in the industry and available in the public domain.

The depiction of a pumping system as shown in FIG. 1 is just one illustrative embodiment of systems that may be used in accordance with the present disclosure, and derivatives of the described system, with additional gas injection/induction ports, positive displacement pumps in the series, control valves, by-pass flow lines, pressure relief valves, flow manifolds, automated controls, flow meters, sample ports, in-line sensors, in-line mixers, and the incorporation of other standard equipment necessary to complete a specific operation or procedure are contemplated to be used and are within the scope of the present disclosure.

In one example embodiment of a method according to the present disclosure, 750 pounds (lbs) of xanthan gum powder is mixed and hydrated in 500 barrel (bbl) of fresh water in the tank or reservoir 10. A chemical injection pump (not shown) is used to pump additive 11, in the present embodiment 0.15 gallons/bbl of a non-ionic surfactant. Injection takes place as shown in FIG. 1, whereupon the liquid is moved into a flow line on the suction side of the transfer displacement pump 12, which in this example embodiment is a tri-lobe positive displacement pump. The liquid having additives mixed therein is discharged at 3 bbl/minute at 80 psi by the transfer pump 12 through a manifold of Venturi tubes, i.e., at 14 in FIG. 1, where at 16, 2.7 standard cubic feet per minute (scf/min) of air is induced into the liquid, resulting a liquid-gas mixture (at 1 atmosphere) having a density of 5 pounds per gallon (ppg). The first positive displacement pump 18, which in this example embodiment may be an axial progressive cavity (screw) pump, is connected at its inlet to the outlet of the manifold 14 receives the liquid-gas mixture at 40 psi and discharges the mixture at 80 psi into the suction side of the second positive displacement pump 20. In this embodiment, the second positive displacement pump 20 may be a quintaplex piston pump that will increase the fluid pressure sufficiently to circulate through the wellbore 22 at 3 bbl/min. The fluid that is returned to surface is reconditioned for reuse in the procedure using standard solids control equipment like shaker screens, centrifuge, and settling tanks. This process is continued throughout an operation, for example, of running production tubing into the wellbore 22, circulating the liquid-gas mixture up the annulus 30 (space between pipe 23 in the wellbore 22 and the wellbore wall 25), and cleaning debris out of wellbore 22.

According to the present disclosure, the creation of a liquid-gas mixture using one or more positive displacements connected in series to the inlet side of the final pump (e.g., the second positive displacement pump 20 in FIG. 1) will expand the utility and efficiency of foams, micro-foams, and colloidal gas aphrons in drilling, completions, work-overs, and underground boring operations. It is within the scope of the present disclosure to provide additional positive displacement pumps in series beyond the second positive displacement pump 20 in the event higher pressure is required to intervene in a subsurface well or bore hole.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A method for pumping a liquid-gas mixture into a subsurface well, comprising:

introducing gas into a liquid flowing at a first pressure to generate a liquid-gas mixture;

pumping the liquid-gas mixture through a first positive displacement pump to a second pressure greater than the first pressure;

pumping the liquid-gas mixture at the second pressure through a second positive displacement pump to a third pressure greater than the second pressure; and moving the liquid-gas mixture into the subsurface well at the third pressure.

2. The method of claim 1, wherein the second pressure is sufficient to avoid cavitation at an inlet to the second positive displacement pump.

3. The method of claim 1, wherein an intake pressure and the second pressure of the liquid-gas mixture is greater than a pressure required to compress a gas fraction of the liquid-gas mixture such that the gas fraction comprises less than 25 percent of a total volume of the liquid-gas mixture being delivered to the second pump.

4. The method of claim 1, further comprising mixing additives into the liquid prior to the introducing gas.

5. The method of claim 1 wherein the introducing gas is performed by induction through a Venturi tube disposed in a line connected to an inlet of the first positive displacement pump.

6. The method of claim 1 wherein the introducing gas is performed using gas at atmospheric pressure.

7. The method of claim 1 wherein the introducing gas is performed by injection at a pressure of 0 to 50 pounds per square inch above the first pressure.

8. The method of claim 1 where in the introducing gas is performed using gas compressed above atmospheric pressure.

9. The method of claim 1 further comprising pumping the mixture from the first positive displacement pump to at least one intermediate positive displacement pump, and pumping the mixture from the at least one intermediate positive displacement pump to the second positive displacement pump at a first intermediate pressure greater than the second pressure, the first intermediate pressure less than the third pressure.

10. A method for pumping a liquid-gas mixture into a subsurface well, comprising:

introducing gas into a liquid flowing at a first pressure to generate a liquid-gas mixture;

pumping the liquid-gas mixture through a first positive displacement pump to a second pressure greater than the first pressure;

pumping the liquid-gas mixture from the first positive displacement pump through at least one intermediate positive displacement pump to a first intermediate pressure greater than the second pressure;

pumping the liquid-gas mixture at the first intermediate pressure through a second positive displacement pump to a third pressure greater than the first intermediate pressure; and moving the liquid-gas mixture into the subsurface well at the third pressure.

11. The method of claim 10, wherein the first intermediate pressure is sufficient to avoid cavitation at an inlet to the second positive displacement pump.

12. The method of claim 10, wherein the intake pressure and the second pressure of the liquid-gas mixture delivered to the second positive displacement pump is greater than the pressure required to compress the gas fraction of the liquid-gas mixture such that the gas fraction comprises less than 25 percent of the total volume of the liquid-gas mixture being delivered to the second pump.

13. The method of claim 10, wherein the intake pressure and the second pressure of the liquid-gas mixture delivered to the second pump is at least sufficient to compress the liquid-gas mixture to an effective compressed density of at least 6.5 pounds per US gallon.

14. The method of claim 10, further comprising the step of introducing gas into the liquid-gas mixture flowing from the first positive displacement pump to the at least one intermediate positive displacement pump.

15. A method for pumping a liquid-gas mixture into a subsurface well, comprising:

introducing gas into a liquid flowing at a first pressure to generate a liquid-gas mixture;

pumping the liquid-gas mixture through a first positive displacement pump to a second pressure greater than the first pressure;

pumping the liquid-gas mixture from the first positive displacement pump through a first intermediate positive displacement pump to a first intermediate pressure greater than the second pressure;

pumping the liquid-gas mixture from the first intermediate positive displacement pump through a second intermediate positive displacement pump to a second intermediate pressure greater than the first intermediate pressure;

pumping the liquid-gas mixture at the second intermediate pressure through a second positive displacement pump to a third pressure greater than the second intermediate pressure; and moving the mixture into the subsurface well at the third pressure.

16. The method of claim 15, wherein the second pressure is sufficient to avoid cavitation at an inlet to the second positive displacement pump.

17. The method of claim 15, wherein the intake pressure and the second pressure of the liquid-gas mixture is greater than the pressure required to compress a gas fraction of the liquid-gas mixture such that the gas fraction comprises less than 25 percent of a total volume of the liquid-gas mixture being delivered to the second pump.

18. The method of claim 15, further comprising mixing additives into the liquid prior to the introducing gas.

19. The method of claim 15 wherein the introducing gas is performed by induction through a Venturi tube disposed in a line connected to an inlet of the first positive displacement pump.

20. The method of claim 15 wherein the introducing gas is performed using gas at atmospheric pressure.

21. The method of claim 15 wherein the introducing gas is performed by injection at a pressure of 0 to 50 pounds per square inch above the first pressure.

22. The method of claim 15 where in the introducing gas is performed using gas compressed above atmospheric pressure.

23. The method of claim 15, wherein an intake pressure and the second pressure of the liquid-gas mixture delivered to the second positive displacement pump is greater than a pressure required to compress a gas fraction of the liquid-gas mixture such that the gas fraction comprises less than 25 percent of a total volume of the liquid-gas mixture being delivered to the second positive displacement pump.

24. The method of claim 15, wherein an intake pressure and the second pressure of the liquid-gas mixture delivered to the second positive displacement pump is at least sufficient to compress the liquid-gas mixture to an effective compressed density of at least 6.5 pounds per US gallon.

* * * * *